US007871293B1

(12) United States Patent
Chung

(10) Patent No.: US 7,871,293 B1
(45) Date of Patent: Jan. 18, 2011

(54) BI-DIRECTIONAL AUDIO CABLE ASSEMBLY

(76) Inventor: John Chung, 19738 Castille La., Saugus, CA (US) 91350

( * ) Notice: Subject to any disclaimer, the term of this patent is extended or adjusted under 35 U.S.C. 154(b) by 0 days.

(21) Appl. No.: 12/584,505

(22) Filed: Sep. 8, 2009

(51) Int. Cl.
*H01R 11/00* (2006.01)

(52) U.S. Cl. ..... 439/502; 439/498; 725/92; 725/80; 725/85; 174/72 A; 174/72 R; 381/309

(58) Field of Classification Search ..... 439/502, 439/498; 725/80, 82, 85; 174/72 A, 72 R; 381/309, 375, 380, 86, 118
See application file for complete search history.

(56) References Cited

U.S. PATENT DOCUMENTS

| | | | | |
|---|---|---|---|---|
| 6,530,085 | B1 | 3/2003 | Periman | |
| 6,583,360 | B1 | 6/2003 | Yudashkin | |
| 6,809,256 | B2 | 10/2004 | Garland | |
| 6,902,427 | B2 | 6/2005 | Kuo | |
| 7,241,179 | B2 | 7/2007 | Chennakeshu | |
| 7,416,440 | B2 | 8/2008 | Homyk et al. | |
| 7,446,258 | B1 | 11/2008 | Sosna et al. | |
| 7,488,187 | B2 | 2/2009 | Wolf | |
| 2008/0205669 | A1 * | 8/2008 | Michelet | 381/118 |
| 2009/0037008 | A1 * | 2/2009 | Moorer et al. | 700/94 |
| 2009/0110211 | A1 * | 4/2009 | Feit | 381/86 |
| 2009/0154738 | A1 * | 6/2009 | Pal | 381/309 |

* cited by examiner

*Primary Examiner*—Gary F. Paumen
(74) *Attorney, Agent, or Firm*—Albert O. Cota

(57) ABSTRACT

A bi-directional audio cable assembly (10) (BACA 10) that functions in combination with an audio amplifier (90), a microphone (92) and a pair of headphones (94). The BACA (10) consists of a single cable that includes an XLR cable (12) that is integrated with a TRS cable (52). The XLR cable (12) has a first end (14) having an XLR plug (44) that is attached to the input of the audio amplifier (90), and a second end (18) having an XLR socket (46) that is attached to the microphone (92). Likewise, the integrated TRS cable (52) has a first end (54) having a TRS plug (64) that is attached to the output of the audio amplifier (90), and a second end (58) that is attached to the pair of headphones (94). The BACA (10) allows a single person to produce an audio signal that is applied via the microphone (92) to the input of the audio amplifier (90) and to hear the same produced audio signal via the pair of headphones (94) without interference from cable-internal noise or external ambient noise.

20 Claims, 4 Drawing Sheets

BI-DIRECTIONAL AUDIO CABLE ASSEMBLY

TECHNICAL FIELD

The invention generally pertains to audio cables, and more particularly to a bi-directional audio cable assembly that includes within a single cable an XLR plug, an XLR socket, a TRS plug and a mini TRS socket. The XLR plug attaches to the input of an audio amplifier, the XLR socket attaches to a microphone, the TRS plug attaches to the output of the amplifier and the mini TRS socket attaches to a headphone.

BACKGROUND ART

In live entertainment, singers, or vocalists, are one of the most prevalent type of performers. This is especially true for live music events, which can range from large venue concerts to weekly services at local houses of worship.

Typically, when there is only a single vocalist, he or she will utilize a microphone to sing into and at least one speaker to function as a monitor. The monitor allows the vocalist to hear himself or herself while on-stage. This type of set-up is generally acceptable for a single vocalist. Problems arise when there are multiple vocalists singing in close proximity to each other.

If, for example, there are six vocalists on stage, there might be six microphones, each with a connecting cable. It is often difficult, if not impossible on a small stage, to provide each vocalist with their own monitor speaker. Some acts attempt to share monitors between 2 or 3 vocalists, which has not been an effective solution. It is very difficult to sing in tune and with correct timing during a live show. The difficulty is magnified when there are multiple vocalists in close proximity who are each trying to hear only themselves over the other vocalists. The only viable solution is to provide each vocalist with a set of headphones that is sending them the vocal feed from their amplifier channel. With the headphones in use, along with the microphones, each vocalist is responsible for at least two cables that are on the stage. When the two cables each are multiplied by the number of vocalists, the stage can quickly become cluttered and un-sightly. Also, having a large number of cables on stage presents a danger of someone tripping over the cables.

Obviously, a better solution is required. If it were possible to present each vocalist with a single-cable that provided microphone amplification and headphone monitoring, the benefits would be significant. Stage clutter would be reduced, safety improved and each vocalist would have their own personal monitoring system.

A search of the prior art did not disclose any literature or patents that read directly on the claims of the instant invention. However, the following U.S. patents are considered related.

| PAT. NO. | INVENTOR | ISSUED |
|---|---|---|
| 7,488,187 | Wolf | 16 Feb. 2009 |
| 6,902,427 | Kuo | 7 Jun. 2005 |
| 6,530,085 | Periman | 4 Mar. 2003 |

The U.S. Pat. No. 7,488,187 discloses a dual channel XLR cable converter that includes a first and a second RCA cable. The two cables terminate at first and second RCA cable connectors at one end and a XLR cable connector at the opposing end. A first signal pin terminal of the XLR cable connector is in electrical communication with the first signal wire of the first RCA cable. A second signal pin terminal of the XLR connector is in electrical communication with the second signal wire of the second RCA cable. A common ground pin terminal of the XLR cable connector is in electrical communication with the first grounding wire of the first RCA cable and a second grounding wire of the second RCA cable. Therefore, the XLR cable converter can be used for conveying single channel RCA cable signals over dual channel XLR cable.

The U.S. Pat. No. 6,902,427 discloses a terminal assembly for a personal computer that integrates an S-video and a composite video terminal into a single socket on an electronic device. The socket includes inlets for separately carrying S-video and composite video signals. The socket can be connected to provide an S-video signal to another device using a standard S-video cable.

The U.S. Pat. No. 6,530,085 discloses a system and method that reduces the complexity of interconnecting various consumer electronics devices. One consumer electronics device forms a central hub to which all other consumer electronics devices are connected by a set of connectors. The connectors are identical and interchangeable in that a cable designed to connect a consumer electronics device to an Internet terminal may be plugged into any of the connectors and operate properly.

For background purposes and as indicative of the art to which the invention relates, reference may be made to the following remaining patents found in the search.

| PAT. NO. | INVENTOR | ISSUED |
|---|---|---|
| 7,446,258 | Sosna et al | 4 Nov. 2008 |
| 7,416,440 | Homyk et al | 26 Aug. 2008 |
| 7,241,179 | Chennakeshu | 10 Jul. 2007 |
| 6,809,256 | Garland | 26 Oct. 2004 |
| 6,583,360 | Yudashkin | 24 Jun. 2003 |

DISCLOSURE OF THE INVENTION

The bi-directional audio cable assembly (BACA) is especially designed to allow a single person to produce an audio signal that is applied via a microphone to the input of an audio amplifier that is connected to various ancillary equipment. The audio amplifier produces an audio output that is heard by means of a pair of headphones that are worn by the same single person. The BACA allows the single person to hear the produced audio signal via the pair of headphones without any interference or noises that are produced by the ambient environment.

In its basic design configuration the BACA is comprised of an XLR cable that is integrated with a TRS cable to form a single cable. The XLR cable has an XLR plug that attaches to the input of the audio amplifier and an XLR socket that attaches to the output of the microphone. The TRS cable has a TRS plug that attaches to the output of the audio amplifier and a TRS socket that attaches to the headphones. The integrated audio cable assembly allows a single person to both produce an audio signal via the microphone and to listen to the same audio signal via the headphone while utilizing a singe cable and without any interference from cable-internal noise and surrounding ambient noise.

The XLR plug and socket used with the BACA are primarily designed to be used in audio cabling applications. In the BACA application, the XLR plug is connected to the input of the audio amplifier and the XLR socket is connected to the microphone. The "X" designation stands for the connector series, the "L" stands for a latch that secures the connector and the "R" stands for a rubber compound that surrounds the XLR contacts.

The TRS plug and sockets used with the BACA are also primarily designed to be used in professional audio cabling applications. In the BACA application the TRS plug is connected to the output of the audio amplifier and the TRS socket is connected to a pair of headphones. The "T" designation stands for the tip of the connector, the "R" stands for a support ring and the "S" stands for a connector sleeve.

In view of the above disclosure, the primary object of the invention is to produce a BACA that allows a person to produce an audio signal that is applied to an amplifier by a single cable and to have an audio monitoring signal return along the same single cable. The return signal is heard by the same person without any interfering cable-internal noise or external ambient noise.

In addition to the primary object of the invention it is also an object of the invention to produce a BACA that:

- can be made in various lengths to accommodate a particular venue or a stage,
- can be made in various colors,
- is flexible,
- allows indicia to be applied to the cable surface,
- reduces stage clutter from multiple cables,
- improve stage safety,
- allows each singer to determine their monitor level, and
- is cost effective for both a manufacturer's and consumer's pound of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms that disclose a preferred embodiment of a bi-directional audio cable assembly 10 (BACA 10). The BACA 10 allows a single person to simultaneously produce and hear the produced audio signal without cable-internal noise or noises that are produced by the ambient external environment.

Figure 1:
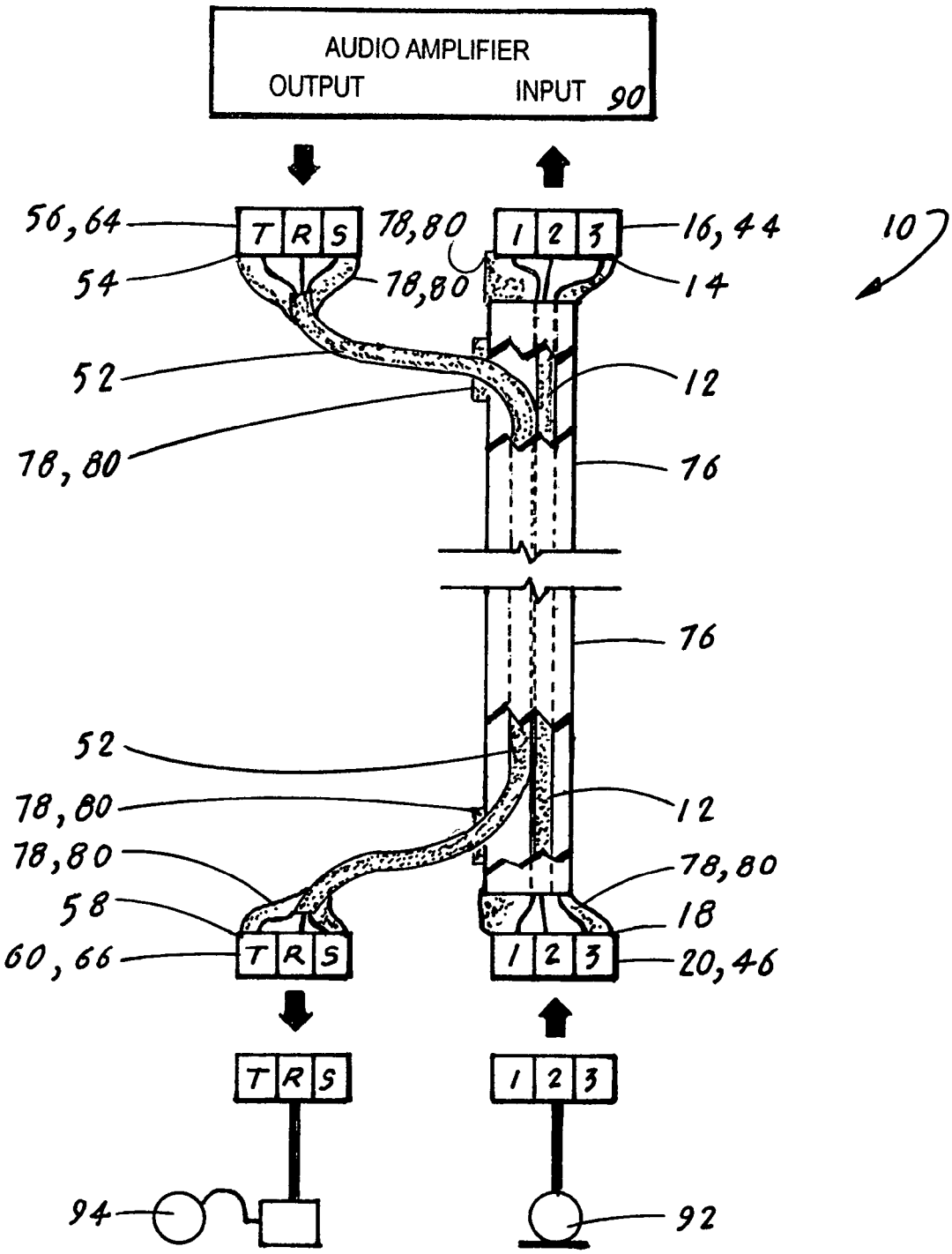
FIG. 1 is a top plan view of a bi-directional audio cable assembly showing the cable assembly connected to an audio amplifier, a microphone and to a pair of headphones.
Figure 2:
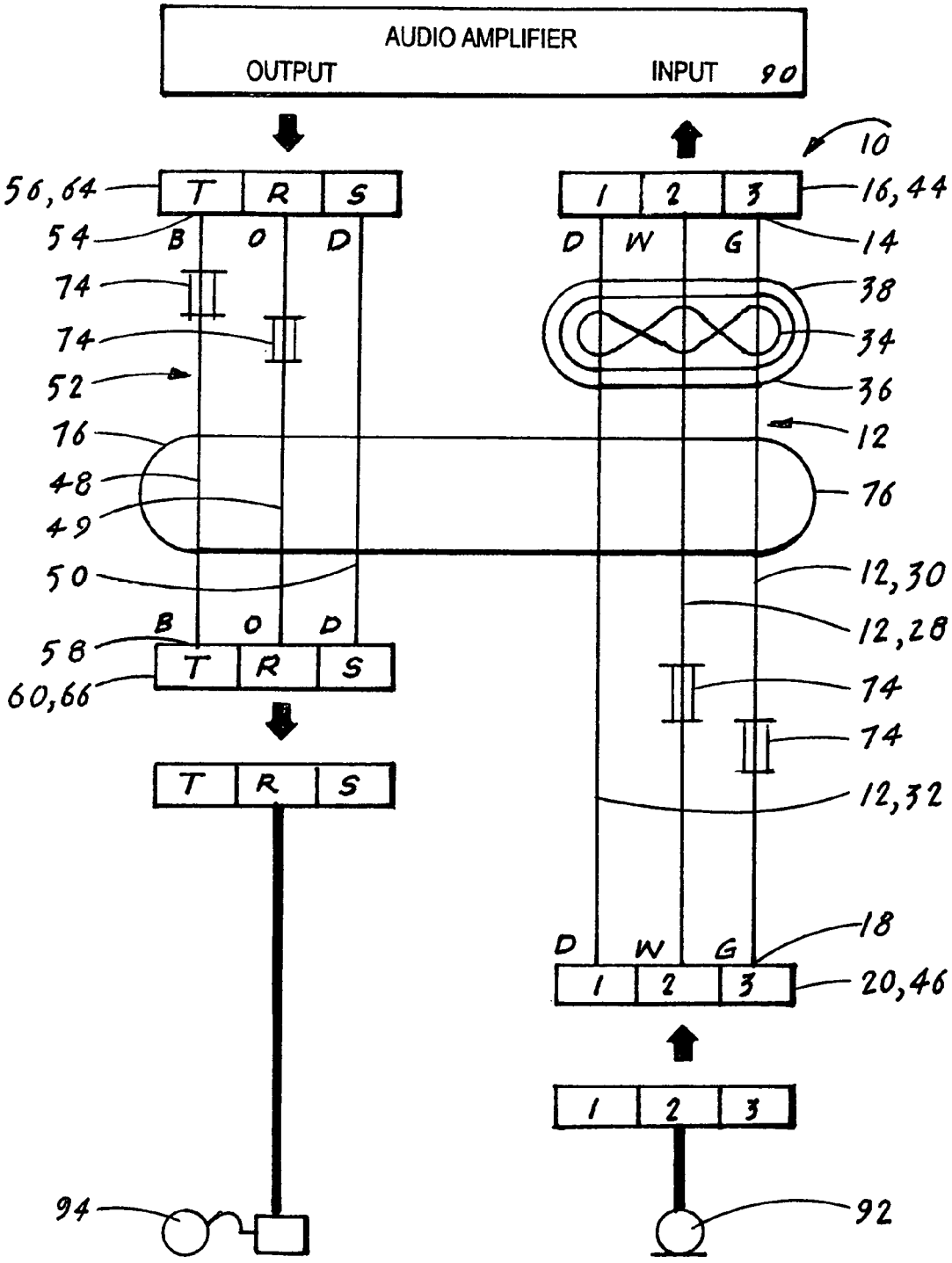
FIG. 2 is a schematic-wiring diagram showing the wiring connections of the XLR cable, the TRS cable and the joining of the two cables to form a single, integrated cable assembly.

The preferred embodiment of the BACA 10, as shown in FIGS. 1-6, is comprised of an XLR cable 12 and a TRS cable 52 that are both encased within a single santoprene jacket 76 to form a single cable, as shown in FIGS. 1 and 2. The BACA 10 is designed to function in combination with an audio amplifier 90, a microphone 92 and a pair of headphones 94 which are also shown in FIGS. 1 and 2.

The XLR cable 12 has a first end 14 that terminates at a first connector 16 and a second end 18 that terminates at a second connector 20. The XLR cable 12, as shown best in FIG. 2, is comprised of an American Wire Gauge (AWG) 24 white (W) tin-copper conductor 28, an AWG 24 green (G) tin-cooper conductor 30 and am AWG 24 drain (D) 32. The two conductors 28,30 and the drain 32 are twisted 34, as shown in FIG. 2, and enclosed within an aluminum-mylar wrap 36 which in turn, is wrapped with a PVC jacket 38. Each of the conductors and the drain are comprised of a 19/36 tin-plated copper.

The first end 14 of the XLR cable 12 is attached to a three conductor XLR plug 44 and the second end 18 of the XLR cable 12 is attached to a three conductor XLR socket 46. As shown in FIGS. 1 and 2, the XLR plug 44 is connected to the input of the audio amplifier 90 and the XLR socket 46 is connected to the output of the microphone 92.

The XLR plug 44, as shown in FIG. 2, has extending from the first end 14, a first connection (1) that is attached to the drain (D), a second connection (2) that is attached to the white (W) conductor, and a third connection (3) that is attached to the green (G) conductor. Likewise, the XLR socket 46 that is attached to the second end 18 of the XLR cable 12 has a first connection (1) that is attached to the drain (D), a second connection (2) that is attached to the white (W) conductor, and a third connection (3) that is attached to the green (G) conductor.

The TRS cable 52, as also shown in FIGS. 1 and 2, has a first end 54 that terminates at a first connector 56 and a second end 58 that terminates at a second connector 60. The TRS cable 52, as shown best in FIG. 2, is comprised of a single AWG 24 blue (B) conductor 48 having an outer PVC jacket 74, a single AWG 24 orange conductor 49 also having an outer PVC jacket 74, and an AWG 24 tin-plated copper drain (D) 50. Each AWG 24 conductor on the TRS cable 52 is also comprised of a 19/36 tin-plated copper conductor.

The first end 54 of the TRS cable 52 is attached to a three conductor TRS plug 64 and the second end 58 of the TRS cable 52 is attached to a three conductor TRS socket 66. The TRS plug 64 is connected to the output of the audio amplifier 90 and the TRS socket 66 is connected to the input of the headphones 94, as shown in FIGS. 1 and 2.

The TRS plug 64 that is attached to the first end 54 of the TRS cable 52, as shown in FIG. 2, has a "T" connection that is attached to the blue (B) conductor, an "R" connection that is attached to the orange (O) conductor, and a "S" connection that is attached to the drain (D).

The TRS socket 66 that is attached to the second end of the TRS cable 52 has a "T" connection that is attached to the blue (B) conductor, a "R" connection that is attached to the orange (O) conductor, and a "S" connection that is attached to the drain (D). The TRS socket 66 is preferably comprised of a 3.5 mm mini-TRS socket 66.

Figure 3:
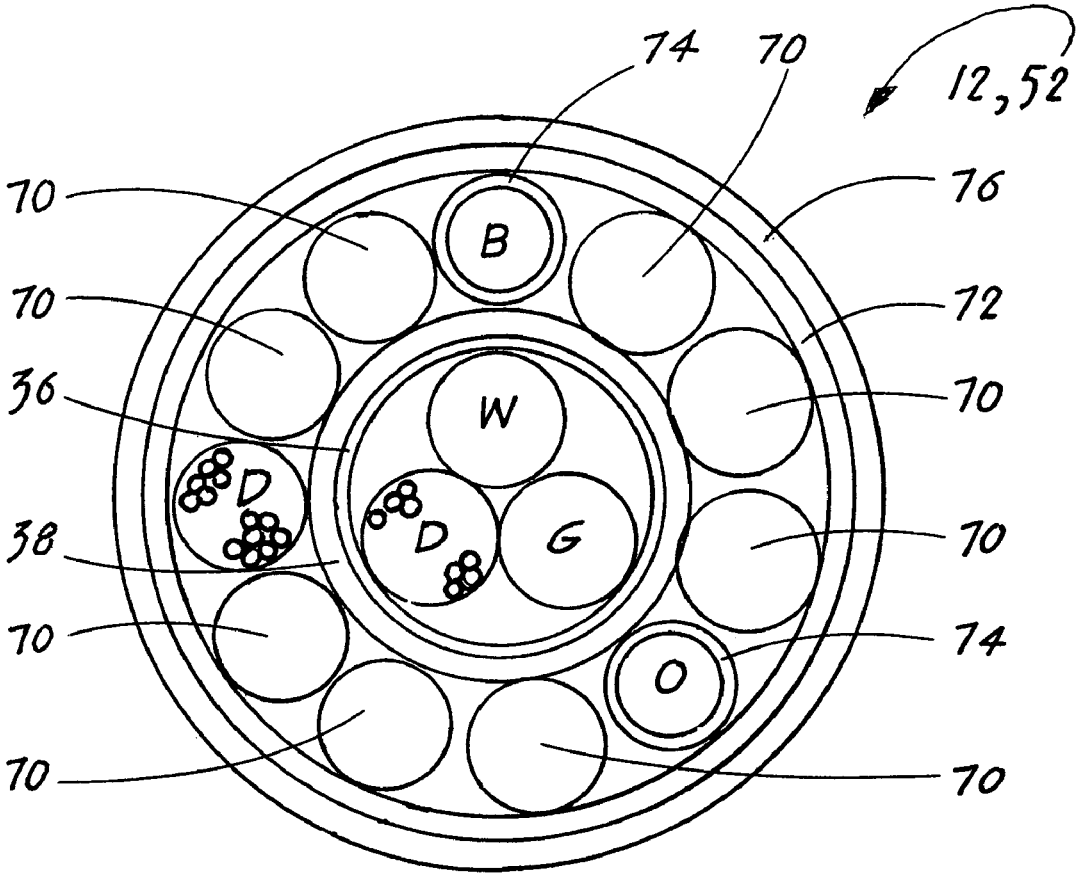
FIG. 3 is a cross-sectional view showing the wiring arrangement of the XLR and TRS cables that comprise the single, integrated cable assembly.
Figure 4:
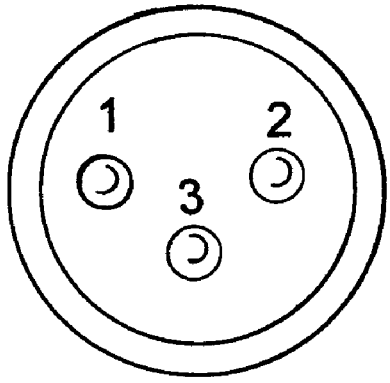
FIG. 4 is a front elevational view of the pin configuration of an XLR plug.
Figure 5:
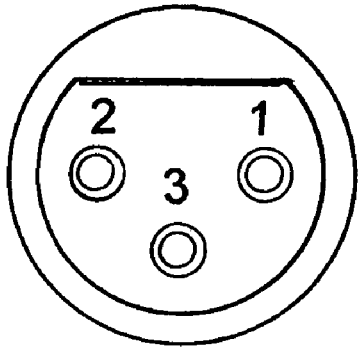
FIG. 5 is a front elevational view of the pin configuration of an XLR socket.
Figure 6:
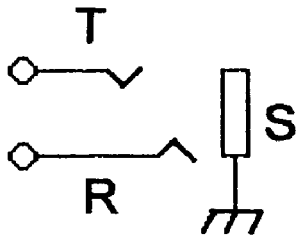
FIG. 6 is a schematic diagram showing the structural elements of a TRS plug and socket and the corresponding letter designations.

Both the XLR and TRS cables, as shown in FIG. 3, are further comprised of a plurality of cotton fillers 70 that surround the XLR and TRS cables 12,52, a foil shield 72 comprised of an aluminum-mylar wrap and that is located around the circumference of the plurality of cotton fillers 70, and a santoprene jacket 76 that is located around the foil shield 72 and that covers the entire outer circumference of the BACA 10. The cable assembly 10 has an overall diameter of 0.24 inches±0.005 inches (0.61±0.0123 cm). To complete the cable assembly 10 a heat shrink tubing 78 or a molded structure 80, as shown in FIG. 1, is placed around each cable-to-cable intersection and to each cable-to-connector intersection.

As shown best in FIG. 1, the santoprene jacket 76 that encompasses both the XLR cable 12 and the TRS cable 52 allows the two cables to form the integrated BACA 10. The BACA 10 allows a single person to both produce an audio signal via the microphone, that is applied to the input of an audio amplifier, and to listen to the produced audio signal from the output of the audio amplifier via the headphone. Thus, any interference from surrounding ambient noise will not distract the single person from listening to their own individual audio signal.

The BACA 10 can be produced in several lengths to accommodate the end user. Typical cable lengths are as follows:

a) the XLR cable 12 can range from 10 feet to 30 feet (3.05 to 9.14 meters)

b) the TRS cable 52 that extends from the first end 14 of the XLR cable 12 can range from 5 to 18 inches (12.7 to 45.72 cm) and c) the TRS cable 52 that extend from the second end 18 of the XLR cable 12 can range from 2 to 10 inches (5.08 to 25.4 cm).

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A bi-directional audio cable assembly (BACA) that is comprised of an XLR cable that is integrated with a TRS cable to form a single cable assembly, wherein:

a) the XLR cable has an XLR plug that attaches to the input of an audio amplifier and an XLR socket that attaches to a microphone, and b) the TRS cable has a TRS plug that attaches to the output of the audio amplifier and a TRS socket that attaches to a pair of headphones, wherein the integrated cable assembly allows a single person by use of a single cable to both produce an audio signal via the microphone, and to listen to the produced audio signal via the pair of headphones, thus any interference from surrounding ambient noise will not distract the single person from listening to the produced audio signal.

2. A bi-directional audio cable assembly (BACA) that functions in combination with an audio amplifier, a microphone and a headphone, wherein said BACA integrally comprises:

a) an XLR cable having a first end that terminates at a first connector and a second end that terminates at a second connector, b) a TRS cable having first end that terminates at a first connector and a second end that terminates at a second connector, and c) a sleeve that encompasses both the XLR cable and the TRS cable to form the integrated said bi-directional audio cable assembly, wherein said cable assembly allows a single person via a single cable to both produce an audio signal via the microphone, that is applied to the input of an audio amplifier, and to listen to the produced audio signal from the output of the audio amplifier via the headphone, thus any interference from surrounding ambient noise will not distract the single person from listening to the produced audio signal.

3. The BACA as specified in claim 2 wherein said XLR cable is comprised of:

a) an AWG 24 white tin-copper conductor, b) an AWG 24 green tin-copper conductor, and c) an AWG 24 drain, wherein the two conductors and the drain are twisted and are enclosed within an aluminum-mylar wrap, which in turn is wrapped with a PVC jacket.

4. The BACA as specified in claim 2 wherein said TRS cable is comprised of:

a) a single AWG 24 blue conductor having an outer PVC jacket, b) a single AWG 24 orange conductor having an outer PVC jacket, and c) an AWG 24 tin-plated copper drain.

5. The BACA as specified in claim 4 wherein said XLR and TRS cables are further comprised of:

a) a plurality of cotton fillers that surround said XLR and TRS cables, b) a foil shield comprised of an aluminum-mylar wrap that is located around the circumference of the plurality of cotton fillers, and c) a santoprene jacket that is located around the foil shield and that covers the entire outer circumference of said bi-directional audio cable assembly.

6. The BACA as specified in claim 4 wherein each of the AWG 24 conductors is comprised of a 19/36 tin-plated copper conductor.

7. The BACA as specified in claim 3 wherein said cable assembly has an overall diameter of 0.24 inches±0.005 inches (0.61±0.0123 cm).

8. The BACA as specified in claim 2 wherein the first end of said XLR cable is attached to a three conductor XLR plug and the second end of said XLR cable is attached to a three conductor XLR socket, wherein the XLR plug is connected to the input of the audio amplifier and the XLR socket is connected to the output of the microphone.

9. The BACA as specified in claim 2 wherein the first end of said TRS cable is attached to a three conductor TRS plug and the second end of said TRS cable is attached to a three conductor TRS socket, wherein the TRS plug is connected to the output of the audio amplifier and the TRS socket is connected to the input of the headphone.

10. The BACA as specified in claim 5 wherein the XLR plug that is attached to the first end of said XLR cable has:

a) a first connection that is attached to the drain, b) second connection that is attached to the white conductor, and c) third connection that is attached to the green conductor.

11. The BACA as specified in claim 5 wherein the XLR socket that is attached to the second end of said XLR cable has:

a) a first connection that is attached to the drain, b) second connection that is attached to the white conductor, and c) third connection that is attached to the green conductor.

12. The BACA as specified in claim 5 wherein the TRS plug that is attached to the first end of said TRS cable has:

a) a "T" connection that is attached to the blue conductor, b) an "R" connection that is attached to the orange conductor, and c) an "S" connection that is attached to the drain.

13. The BACA as specified in claim 5 wherein the TRS socket that is attached to the second end of said TRS cable has:

a) a "T" connection that is attached to the blue conductor, b) an "R" connection that is attached to the orange conductor, and c) an "S" connection that is attached to the drain.

14. The BACA as specified in claim 13 wherein the TRS socket is comprised of a 3.5 mm mini-TRS socket.

15. The BACA as specified in claim 13 wherein the drain is connected to ground.

16. The BACA as specified in claim 2 further comprising heat shrink tubing that is placed around each cable-to-cable intersection and to each cable-to-connector intersection.

17. The BACA as specified in claim 2 further comprising a molded structure that is placed around each cable-to-cable intersection and to each cable-to-connector intersection.

18. The BACA as specified in claim 2 wherein the XLR cable has a length ranging from 10 to 30 feet (3.05 to 9.14 meters).

19. The BACA as specified in claim 2 wherein the TRS cable that extends from the first end of said XLR cable ranges from 5 to 18-inches (12.7 to 45.72 cm).

20. The BACA as specified in claim 2 wherein the TRS cable that extends from the second end of said XLR cable ranges from 2 to 10-inches (5.08 to 25.4 cm).

* * * * *